US007051880B1

(12) United States Patent
Bills

(10) Patent No.: US 7,051,880 B1
(45) Date of Patent: May 30, 2006

(54) AIR CLASSIFIER TO SEPARATE SOLIDS WHILE ELIMINATING EMISSIONS

(75) Inventor: Marlin D. Bills, Jenks, OK (US)

(73) Assignee: Osborn Engineering, Inc., Tulsa, OK (US)

( * ) Notice: Subject to any disclaimer, the term of this patent is extended or adjusted under 35 U.S.C. 154(b) by 0 days.

(21) Appl. No.: 10/908,527

(22) Filed: May 16, 2005

Related U.S. Application Data

(60) Provisional application No. 60/582,285, filed on Jun. 23, 2004.

(51) Int. Cl.
*B07B 7/10* (2006.01)

(52) U.S. Cl. ..... 209/147; 209/721

(58) Field of Classification Search ..... 209/146, 209/147, 149, 717, 721, 906; 241/19, 79.1
See application file for complete search history.

(56) References Cited

U.S. PATENT DOCUMENTS

| | | | | | |
|---|---|---|---|---|---|
| 888,158 | A | * | 5/1908 | Gillette | 248/458 |
| 1,562,411 | A | | 11/1925 | Caracristi et al. | |
| 1,859,771 | A | | 5/1932 | Hardinge | |
| 1,985,250 | A | | 12/1934 | Goss et al. | 34/34 |
| 2,203,959 | A | * | 6/1940 | Hammack | 209/137 |
| 2,480,998 | A | * | 9/1949 | Brackett | 241/19 |
| 2,841,384 | A | | 7/1958 | Peterson | 263/32 |
| 2,916,215 | A | | 12/1959 | Weston et al. | 241/19 |
| 3,694,037 | A | * | 9/1972 | Feder | 406/23 |
| 3,727,755 | A | | 4/1973 | Cristiani | 209/45 |
| 3,794,251 | A | * | 2/1974 | Williams | 241/65 |
| 4,061,274 | A | | 12/1977 | Williams | 241/24 |
| 4,641,788 | A | * | 2/1987 | Williams | 241/14 |
| 5,388,773 | A | | 2/1995 | Perry | 241/19 |
| 5,423,433 | A | | 6/1995 | Arnold et al. | 209/636 |
| 5,437,374 | A | | 8/1995 | Bills et al. | 209/288 |
| 5,839,673 | A | * | 11/1998 | Williams | 241/48 |
| 5,971,302 | A | * | 10/1999 | Doumet | 241/17 |
| 6,390,273 | B1 | | 5/2002 | Muller | 198/347.1 |
| 6,394,371 | B1 | | 5/2002 | Ribardi | 241/5 |
| 6,581,858 | B1 | | 6/2003 | Deklerow et al. | 241/19 |
| 6,588,686 | B1 | | 7/2003 | Dingee, IV et al. | 241/5 |

* cited by examiner

*Primary Examiner*—Joseph C. Rodriguez
(74) *Attorney, Agent, or Firm*—Head, Johnson & Kachigian

(57) ABSTRACT

An air classifier to separate solids by air classification while eliminating emissions. The air classifier includes an in-feed delivery mechanism, such as a continuous conveyer belt in order to deliver solids to an input chamber. A hanging curtain is movable in response to solids entering the input chamber. A balanced gate moves in response to solids exiting from the input chamber. An air fan delivers forced air to an air classifier chamber which is in communication with the input chamber. A heavy fraction discharge is in communication with the air classifier chamber to receive a portion of the solids heavier than the force of air delivered to the air classifier chamber. A light fraction discharge in communication with the air classifier chamber removes light solids. A return air duct in communication with the light fraction discharge returns air from the light fraction discharge to the fan. A bleed-off duct delivers a portion of forced air from the fan back into the input chamber.

15 Claims, 2 Drawing Sheets

AIR CLASSIFIER TO SEPARATE SOLIDS WHILE ELIMINATING EMISSIONS

CROSS-REFERENCE TO PENDING APPLICATIONS

This application is based on U.S. Provisional Patent Application No. 60/582,285 filed Jun. 23, 2004 and entitled "Air Classifier Cleaning System Emission Source Eliminator".

BACKGROUND OF THE INVENTION

1. Field of the Invention

The present invention relates to an air classifier method and apparatus in order to separate solids by air classification while eliminating emissions. More specifically, this invention is directed to an air classifier system which eliminates emissions, provides a substantially closed circulating system, and eliminates the need for bleed off of air in the system.

2. Prior Art

Air classifier systems have been in use for a number of years and are used in various applications. In one known application, materials to be separated and classified come from the result of shredding of waste materials, such as cars or vehicle parts. The cars or other materials are initially put through a shredder which pulls apart the materials. They may also separate the materials, such as with magnets so that metal materials are pulled off. In other cases, a trommel device may be used so that materials under a certain size will be separated.

The resulting material or materials are then used as an in-feed product on an in-feed conveyer to an air classifier separating system. Materials that are heavier than the force of the air driven by the fan drop by gravity into a large fraction discharge chute. Materials that are lighter than the force of air driven by the fan, sometimes referred to as "fluf" are driven up through a light fraction discharge chute and gathered in a hopper.

The air classifier system is a continuous flow system with forced air from the lighter fraction discharge passed back toward the air fan so that the system operates in continuous fashion. Although a hanging curtain or other mechanism is used at the in-feed conveyor, the force of air through the system will draw a portion of air in from the atmosphere.

If this incoming air is not vented, the efficiency of the system is reduced and/or airflow will escape somewhere from the system.

Accordingly, many existing air classifier systems include a bleed-off duct or bleed-off exhaust. A certain amount of air in the system is bled off through a duct into the atmosphere. The bleed-off duct may include a manual damper to adjust the rate of flow. This bleed-off fraction may be up to 10%–20% of the total airflow through the system depending upon the amount of air leaking in the system.

A significant problem with conventional bleed-off exhaust is that the fluid from the bleed-off is dust and dirt-laden, which when exhausting through a discharge stack, results in unwanted emission. The amount of dust being emitted may be in excess of allowable emission levels and an air permit may be required to operate the system. Another problem with conventional bleed-off exhaust is that due to excessive emissions, the past remedies have been to add secondary collection devices such as filters or wet scrubbers, all of which are costly to purchase, maintain and operate. Another problem with conventional bleed-off exhausts is that due to many stringent air permitting issues, many people will not consider the main air classifier as a viable process for their location, which results in either an inferior process, or inferior finished product, or no process at all.

While existing devices may be suitable for the particular purpose to which they address, they are not as suitable for eliminating the need for a bleed-off stack from an air classifying cleaning system, and thus eliminating air pollution or the need for a permit to operate an air emission source.

It is a further object and purpose of the present invention to provide an air classifier to separate solids which eliminates the normal need for a bleed-off stack or duct, eliminating the air pollution generated.

It is a further object and purpose of the present invention to provide an air classifier having an emission source eliminator.

It is a further object and purpose of the present invention to provide an air classifier to separate solids which results in a closed fluid system.

Another object and purpose of the present invention is to provide an air classifier to separate solids which decreases the need to obtain governmentally issued emission permits.

A further object and purpose of the present invention is to provide an improved air classifier system that may retrofit to existing systems or incorporated in new systems.

SUMMARY OF THE INVENTION

The present invention is directed to a method and apparatus to separate solids by air classification while eliminating emissions. A continuous conveyor transports and delivers solids to be separated by air classification. The solids move up to and past a hanging curtain which is suspended above the level of the conveyor from a shroud. Beyond the hanging curtain is an input chamber. Spaced from the hanging curtain and at an opposite end of the input chamber is a mechanically balanced gate which is contained within the shroud. A relatively closed input chamber is formed by the shroud, the hanging curtain, the balanced gate and the conveyor.

The mechanically balanced gate includes a central shaft which is rotatable about an axis that is generally parallel to the axis of the conveyor roller. Extending from the central shaft is a pair of radially extending rigid plates. Also extending from the central shaft outside of the shroud is a weighted arm to balance the shaft and the plates so that one plate is normally near or resting on the conveyor. Accordingly, little if any airflow is normally permitted. The plate moves in response to contact from solids moving from the input chamber toward an air classifier chamber.

Forced air is delivered by a fan or fans into the air classifier chamber. Solids heavier than the force of air moving through the air classifier chamber will fall by weight of gravity downward into a heavy discharge chute. A hanging curtain is movable in response to force from solids passing therethrough.

Solids which are lighter than the force of air moving through the air classifier chamber are driven upward through a light fraction discharge chute. The forced air and entrained solids passing through the light fraction discharge chute pass into a cylindrical cyclone chamber. Solids, such as dirt and dust, are driven outward by a centrifugal force toward the walls of the cyclone chamber. Upon impact against the walls of the cyclone chamber, solids will have a tendency to thereafter fall by gravity where they are gathered in a surge hopper.

The forced air moving into the cyclone chamber is thereafter moved into and through a return air duct toward the fan. Additionally, a fan discharge duct moves the majority of air back to the air classifier. A portion of the air, which had previously exhausted to atmosphere, is diverted by an adjustable bleed off valve and returns to the input chamber. The resultant air pressure of the returned air between the hanging curtain and the balanced gate is greater or equal to the outside atmospheric pressure. The velocity of the air is directed towards the balanced air gate lower plate, which effectively eliminates any further leakage of outside air into the chamber. By eliminating leakage, the need for bleed off air exhausting to atmosphere is also eliminated.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
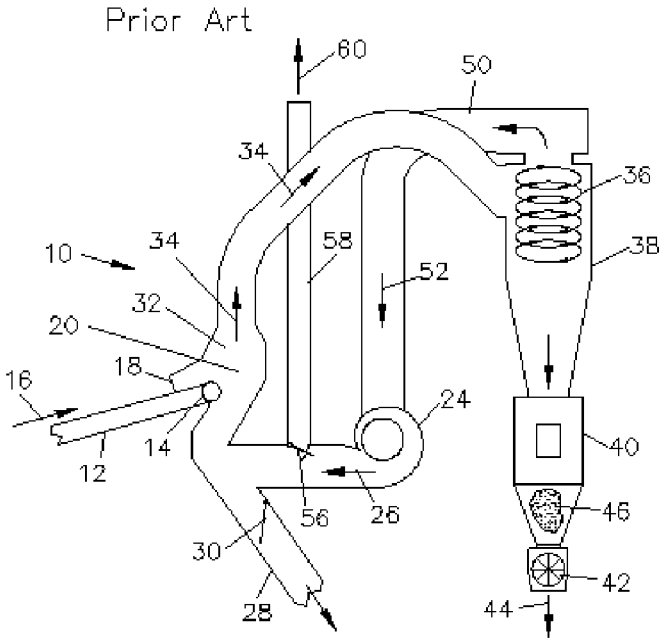
FIG. 1 is a diagrammatic view of a prior art air classifier system before application of the present invention.

Referring to the drawings in detail, FIG. 1 illustrates a prior art, existing air classifier 10 to separate solids. A continuous conveyor 12 (only a portion shown) having a belt and a roller 14 or rollers, delivers solids to be separated by air classification to the classifier 10 in the direction shown by arrow 16. The solids move up to and past a hanging curtain 18 which is suspended above the conveyor belt into an air classifier chamber 20 in communication with the conveyor 14 at an end thereof. The hanging curtain may include a first set of rubber skirts and a second set of hanging steel bars.

Forced air is delivered via a fan or fans 24 in the direction of arrow 26 into the air classifier chamber 20.

Solids which are heavier than the force of air moving through the air classifier chamber 20 will fall by weight of gravity downward from the air classifier chamber 20 into a heavy discharge chute 28. A hanging curtain 30 is moveable in response to force from solids passing therethrough.

Solids which are lighter than the force of air moving through the air classifier chamber 20 are driven upward through a light fraction discharge chute 32 in the direction shown by arrows 34.

The forced air and entrained solids passing through the light fraction discharge chute 32 pass into a cylindrical cyclone chamber 38. The walls of the cyclone chamber 38 are cylindrical so that the forced air circulates in a circular or helical pattern as illustrated by arrow 36. Solids such as dirt and dust are driven outward by centrifugal force toward the walls of the cyclone chamber 38. Upon impact against the interior walls of the cyclone chamber, solids will have a tendency to fall by gravity where they are gathered in a surge hopper 40, a portion of which is cut-away at 46 to reveal the solids stored therein. The closed surge hopper 40 includes a rotary air lock mechanism 42. The air lock mechanism includes a rotatable paddle wheel which, when rotated, will release the solids as illustrated by arrow 44.

The forced air moving into the cyclone chamber 38 is thereafter moved into and through a return air duct 50 in the direction illustrated by arrow 52 toward the fan 24.

Because of the force of air circulating through the system and through the air classifier chamber 20, in particular, a negative pressure results at the hanging curtain 18 wherein solids are input into the system, thus, allowing air leakage. Accordingly, a certain amount of air in the system must be released or bled off. Accordingly, many existing systems include an adjustable bleed-off valve 56 and a bleed-off duct 58 as illustrated by arrow 60.

By way of example, but not by limitation, known air classifying systems used in metal shredding processes can range from 30,000 to 120,000 CFM (cubic feet per minute) of total air flow. The bleed-off or exhaust requirement for these types of systems can then result in a volume of 3,000 to 12,000 CFM. If this volume of exhaust air is considerably dirt or dust laden, then the exhaust may become a problem. Previous solutions to this issue include secondary collection devices, such as Venturi scrubbers and bag filters operating as an attachment to the bleed-off duct.

Figure 2:
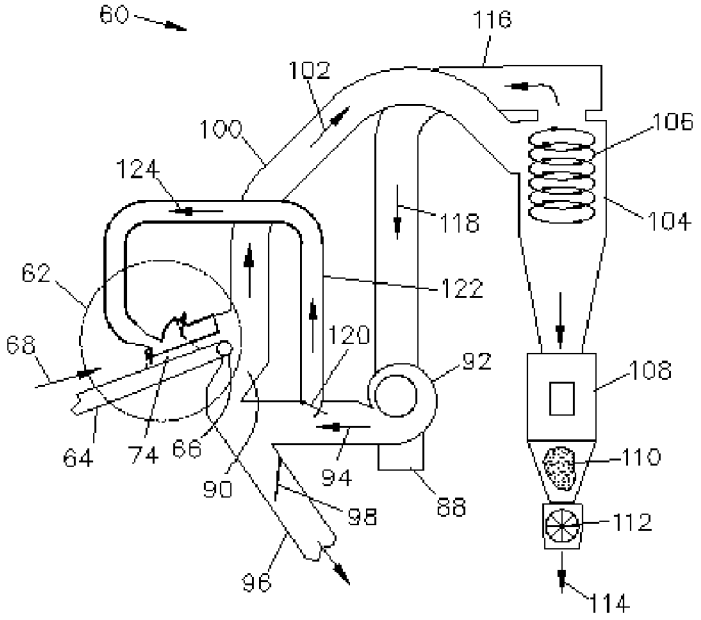
FIG. 2 illustrates a diagrammatic view of an apparatus to separate solids by air classification.
Figure 3:
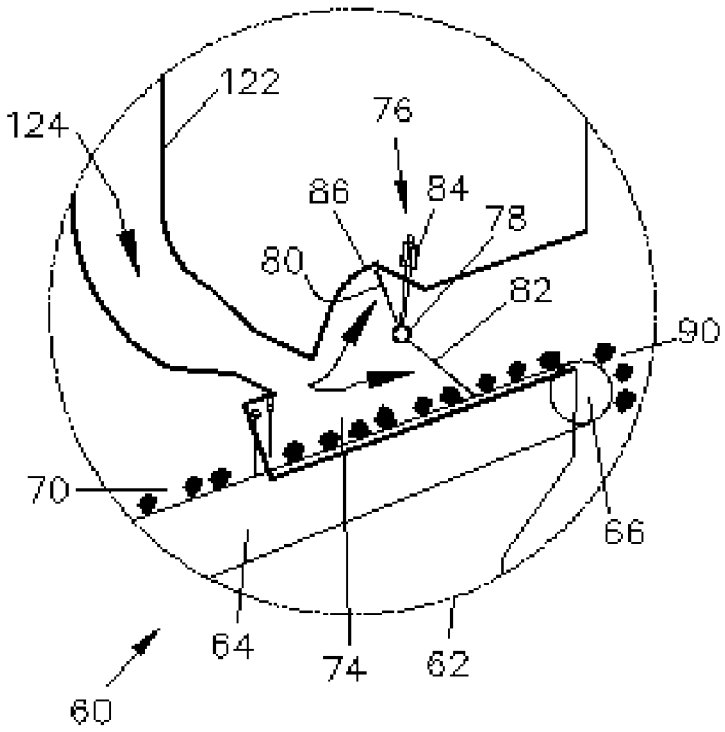
FIG. 3 illustrates a portion of the apparatus shown in FIG. 2 enlarged for clarity.
Figure 4:
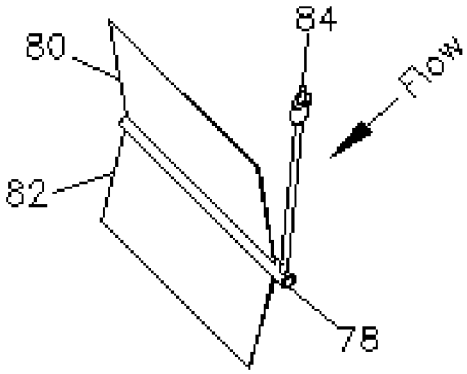
FIG. 4 illustrates a balanced air gate of the apparatus shown in FIGS. 2 and 3.

FIG. 2 illustrates a diagrammatic view of a method and apparatus 60 to separate solids by air classification while eliminating emissions incorporating the teachings of the present invention and FIG. 3 is an enlarged view of a portion of the classifier apparatus shown by dashed lines 62 in FIG. 2.

A continuous conveyor 64 (only a portion of which is shown in FIG. 2) having a roller 66 or rollers transports and delivers solids to be separated by air classification to the classifier apparatus 60 in a direction as shown by arrow 68. As best seen in FIG. 3, the solids 70 move up to and past a hanging curtain 72 which is suspended above the level of the conveyor 64. The hanging curtain 72 may be composed of a flexible rubber or other material which will move in response to contact from solids 70 on the conveyor.

Beyond the hanging curtain 72 is an input chamber 74. Spaced from the hanging curtain 72 and at an opposed end of the input chamber 74 is a mechanically balanced gate 76. The mechanically balanced gate is contained within a shroud 86. A relatively closed input chamber is formed by the shroud, hanging curtain, balanced gate and conveyor.

The mechanically balanced gate 76 includes a central shaft which is rotatable about an axis that is generally parallel to the axis of the roller 66. Extending from the central shaft 78 is a pair of radially extending rigid plates 80 and 82. Also extending from the central shaft 78 outside the shroud 86 is a weighted arm or arms 84 to balance the shaft and plates 80 and 82 so that plate 82 is normally near or resting on the conveyor 64 so that little, if any, air flow is permitted. The plate 82 will move in response to contact from solids 70 moving from the input chamber 74. The balanced gate operates on the same principle as a revolving door, which will let personnel through, but will not intermingle air characteristics from either side. The balanced 76 gate will rotate open when a solid particle on the conveyor belt forces up against the lower plate. The gate is balanced using adjustable counterbalance arms which will allow the gate to return to the closed position when there are no solid particles present. The gate will only open as far as necessary to accommodate the particular size of particle, and then will return to the closed position. The bottom plate is positioned at a 45 degree angle to the belt surface. The lower portion of the plate consists of a rubber seal which touches the conveyor belt surface.

Solids will move via the conveyor from the input chamber 74 into an air classifier chamber 90.

Forced air is delivered via a fan or fans 92 in the direction of arrow 94 into the air classifier chamber 90. As an option, an electronic variable frequency inverter 88 may be added to the fan 92 to adjust air flow in the system. The inverter 88 can, in turn, be connected or operated by an automatic computer controlled set of parameters to control airflow.

Solids which are heavier than the force of air moving through the air classifier chamber 90 will fall by weight of gravity downward from the air classifier chamber 90 into a heavy discharge chute 96. A hanging curtain 98 is movable in response to force from solids passing therethrough.

Solids which are lighter than the force of air moving through the air classifier chamber 90 are driven upward through a light fraction discharge chute 100 in the direction shown by arrow 102.

The forced air and entrained solids passing through the light fraction discharge chute 100 pass into a cylindrical cyclone chamber 104. The walls of the cyclone chamber 104 are cylindrical so that the forced air which enters into the chamber tangentially circulates in a circular or helical pattern as illustrated by arrow 106. Solids such as dirt and dust are driven outward by centrifugal force toward the walls of the cyclone chamber 104. Upon impact against the interior walls of the cyclone chamber, solids will have a tendency to thereafter fall by gravity where they are gathered in a surge hopper 108, a portion of which is cut-away at 110 to reveal the solids stored therein.

The surge hopper 108 is generally closed but includes a rotary air lock mechanism 112. The air lock mechanism 112 includes a rotatable paddle wheel, which, when rotated, will release the solids as illustrated by arrow 114.

The forced air moving into the cyclone chamber 104 is thereafter moved into and through a return air duct 116 in the direction illustrated by arrow 118 toward the fan 92. Additionally, a fan discharge duct moves the majority of air back to the air classifier. A portion of the air is diverted by an adjustable bleed off valve and returns to the input chamber. The resultant air pressure of the returned air between the hanging curtain and the balanced gate is greater or equal to the outside atmospheric pressure. The velocity of the air is directed towards the balanced air gate lower plate, which effectively eliminates any further leakage of outside air into the chamber. By eliminating leakage, the need for bleed off air exhausting to atmosphere is also eliminated.

The present invention may be employed as a modification or retrofit to existing classifiers as shown in FIG. 1.

When an existing system is modified, a return duct may be added to the original bleed-off stack, a balanced airgate to reduce leakage, a properly located "re-injection" nozzle and a secondary seal. The duct nozzle is connected to the bleed-off stack with necessary ducting to position the duct nozzle in a precise location mounted at an optimum point at which the most amount of air is leaking into the system, which is resulting in the bleed-off requirement. This is typically located above a conveyor which is feeding the classifying cleaning chamber. The duct nozzle will typically be a round to rectangular transition shape which will evenly disperse the former bleed-off air over the surface of the conveyor belt. This returned air will be the only source of air leakage makeup, when used in conjunction with the other components listed. The ducting diameter will be sized for appropriate airflow. The ducting length and number of elbows and fittings will be changed to accommodate physical locations of bleed-off stack relative to the conveyor leakage point. The nozzle will generally be shaped to re-inject air to the conveyor surface at a 45 degree angle (45°) with airflow discharging towards the classifier cleaning chamber. Other re-injection angles may prove to be more effective. The full conveyor face rectangular discharge of the nozzle may be changed to other more effective shapes.

Whereas, the present invention has been described in relation to the drawings attached hereto, it should be understood that other and further modifications, apart from those shown or suggested herein, may be made within the spirit and scope of this invention.

What is claimed is:

1. A method to separate solids by air classification while eliminating emissions, which method comprises:

delivering solids to an input chamber having a hanging curtain and a balanced gate;

delivering solids from said input chamber into an air classifier chamber;

delivering forced air via fan into said air classifier chamber so that heavy solids will fall to a heavy fraction discharge and lighter solids will be delivered to a light fraction discharge;

returning said forced air from said light fraction discharge through a return duct to said fan; and bleeding off a portion of said forced air from said fan and delivering into said input chamber instead of exhausting to the atmosphere.

2. The method to separate solids as set forth in claim 1 wherein said step of delivering solids to an input chamber is accomplished by a continuous conveyor belt.

3. The method to separate solids as set forth in claim 2 wherein said portion of said forced air bled off is delivered into said input chamber instead of exhausting to the atmosphere at an acute angle to said conveyor belt.

4. The method to separate solids as set forth in claim 2 wherein said gate is mechanically balanced and has a pair of radially extending rigid plates which extend from a central shaft, rotatable about an axis.

5. The method to separate solids as set forth in claim 4 wherein said axis is parallel to said conveyor belt and wherein said gate is in a normally closed position.

6. The method to separate solids as set forth in claim 1 including the additional step of passing said forced air through a cyclone chamber to separate solids prior to returning to said fan.

7. The method to separate solids as set forth in claim 6 including the step of collecting said solids in a surge hopper.

8. An air classifier for separating solids, which classifier comprises:

an infeed delivery mechanism to deliver solids to an input chamber;

a hanging curtain, movable in response to solids entering said input chamber;

a balanced gate which moves in response to solid exiting said input chamber;

an air fan which delivers forced air to an air classifier chamber in communication with said input chamber;

a heavy fraction discharge in communication with said air classifier chamber to receive a portion of said solids;

a light fraction discharge in communication with said air classifier chamber to remove light solids;

a return air duct in communication with said light fraction discharge to return air from said light fraction discharge to said fan; and a bleed-off duct delivering a portion of forced air from said fan back into said input chamber through a re-injection nozzle.

9. The air classifier as set forth in claim 8 including a cyclone separation chamber to separate solid particles from said light fraction.

10. The air classifier system as set forth in claim 8 wherein said in-feed delivery mechanism is a continuous conveyor belt.

11. The air classifier system as set forth in claim 8 including a cyclone chamber in communication with said light fraction discharge to separate solids from said light fraction discharge.

12. The air classifier system as set forth in claim 11 including a surge hopper below said cyclone chamber to hold said solids.

13. The air classifier as set forth in claim 8 including a hanging curtain in said heavy fraction discharge.

14. The air classifier as set forth in claim 10 wherein said hanging curtain, said balanced gate and said conveyor belt together result in said input chamber being normally closed.

15. The air classifier as set forth in claim 8 wherein said balanced gate is mechanically balanced and has a pair of radially extending rigid plates which extend from a central shaft.

* * * * *